US009978316B2

(12) United States Patent
Hayashi et al.

(10) Patent No.: US 9,978,316 B2
(45) Date of Patent: May 22, 2018

(54) DISPLAY APPARATUS AND BACKLIGHT DRIVE METHOD

(71) Applicant: EIZO Corporation, Ishikawa (JP)

(72) Inventors: Akinori Hayashi, Ishikawa (JP); Hideaki Hashimoto, Ishikawa (JP); Masaaki Murai, Ishikawa (JP); Daiki Takeda, Ishikawa (JP)

(73) Assignee: EIZO Corporation, Ishikawa (JP)

( * ) Notice: Subject to any disclaimer, the term of this patent is extended or adjusted under 35 U.S.C. 154(b) by 128 days.

(21) Appl. No.: 14/989,800

(22) Filed: Jan. 7, 2016

(65) Prior Publication Data

US 2016/0117999 A1 Apr. 28, 2016

Related U.S. Application Data

(63) Continuation of application No. PCT/JP2014/068534, filed on Jul. 11, 2014.

(30) Foreign Application Priority Data

Jul. 11, 2013 (JP) ..... 2013-1455221

(51) Int. Cl.
*G09G 3/36* (2006.01)
*G09G 3/34* (2006.01)

(52) U.S. Cl.
CPC ..... *G09G 3/3406* (2013.01); *G09G 3/3648* (2013.01); *G09G 2310/0237* (2013.01);
(Continued)

(58) Field of Classification Search
CPC ..... G09G 3/3406; G09G 3/3648; G09G 2320/064; G09G 2310/08;
(Continued)

(56) References Cited

U.S. PATENT DOCUMENTS

2008/0074367 A1* 3/2008 Kimura ..... G09G 3/3648 345/87
2009/0179848 A1 7/2009 Schmidt et al.
(Continued)

FOREIGN PATENT DOCUMENTS

JP H5-303078 A 11/1993
JP 2008-102442 A 5/2008
(Continued)

OTHER PUBLICATIONS

Notice of First Office Action for Patent Application No. 201480039585.6, issued by The State Intellectual Property Office of the People's Republic of China dated Feb. 22, 2017.
International Search Report for International Patent Application No. PCT/JP2014/068534, issued by the Japan Patent Office dated Oct. 7, 2014.
(Continued)

*Primary Examiner* — Christopher E Leiby

(57) ABSTRACT

A display apparatus including a drive control section that performs control to repeatedly switch between a drive time period during which a backlight emits light and a rest time period during which the backlight does not emit light, in an alternating manner with a prescribed period. The drive control section controls a ratio between the drive time period and the rest time period, and controls the amount of drive current supplied to the backlight during the drive time period. The drive control section sets the rest time period to be a prescribed time period and controls the amount of the drive current for a range where an adjustment value is less than a prescribed value, and sets the drive current to a prescribed value and makes the rest time period shorter than the prescribed time period for a range where the adjustment value is greater than the prescribed value.

10 Claims, 7 Drawing Sheets

(52) U.S. Cl.
CPC . *G09G 2310/08* (2013.01); *G09G 2320/0247* (2013.01); *G09G 2320/0261* (2013.01); *G09G 2320/064* (2013.01); *G09G 2320/0633* (2013.01)

(58) Field of Classification Search
CPC ... G09G 2310/0237; G09G 2320/0247; G09G 2320/0261; G09G 2320/0633
See application file for complete search history.

(56) References Cited

U.S. PATENT DOCUMENTS

| | | | | |
|---|---|---|---|---|
| 2010/0034272 | A1 | 2/2010 | Miyazaki et al. | |
| 2011/0157111 | A1 | 6/2011 | Lee et al. | |
| 2012/0105515 | A1 | 5/2012 | Iwasaki et al. | |
| 2013/0021386 | A1* | 1/2013 | Min | G09G 3/34 345/690 |
| 2013/0057600 | A1 | 3/2013 | Kim et al. | |
| 2014/0292634 | A1* | 10/2014 | Kita | G09G 3/342 345/102 |

FOREIGN PATENT DOCUMENTS

| | | | |
|---|---|---|---|
| JP | 2009-90236 | A | 4/2009 |
| JP | 2010-243660 | A | 10/2010 |

OTHER PUBLICATIONS

Extended European Search Report for European Patent Application No. 14 823 497.4, issued by the European Patent Office dated Jan. 12, 2017.

Office Action issued for counterpart Japanese Application 2013-145521, issued by the Japan Patent Office dated Apr. 25, 2017.

Extended European Search Report for European Patent Application No. 14823497.4, issued by the European Patent Office dated Sep. 6, 2017.

Notice of Second Office Action for Patent Application No. 201480039585.6, issued by The State Intellectual Property Office of the People's Republic of China dated Aug. 16, 2017.

Office Action issued for counterpart Chinese Application 201480039585.6, issued by the Chinese Intellectual Property Office dated Dec. 4, 2017.

* cited by examiner

DISPLAY APPARATUS AND BACKLIGHT DRIVE METHOD the contents of the following patent application are incorporated herein by reference:

No. 2013-145521 filed on Jul. 11, 2013, and

No. PCT/JP2014/068534 filed on Jul. 11, 2014.

BACKGROUND

1. Technical Field

The present invention relates to a display apparatus including a display panel and a backlight and to a backlight drive method.

2. Related Art

A transparent display apparatus such as an LCD (Liquid Crystal Display) apparatus or MEMS (Micro Electrical Mechanical System) display apparatus includes a display panel, a backlight arranged behind the display panel, and the like, and adopts a so-called PWM light adjustment method as a method for adjusting the luminance (brightness) of the display panel. The PWM light adjustment method includes adjusting the current supplied to the backlight by changing the pulse width (duty ratio) of a pulse signal.

In recent years, the principles of PWM light control have been used to realize blinking backlight control that improves moving image visibility of a display panel. This blinking backlight control includes performing control causing the backlight to flash in synchronization with a vertical synchronization signal at the end of a field of a video signal for the display panel, such that the video is not seen during the flashing of the backlight, thereby causing video images to appear in an overlapping manner, as shown in Patent Document 1, for example.

Patent Document 1: Japanese Patent Application Publication No. H5-303078

However, when performing the blinking backlight control, the maximum luminance of the liquid crystal panel decreases due to the flashing time period of the backlight, and therefore there is a problem that the light adjustment range of the liquid crystal panel becomes narrow.

In light of the above situation, it is an objective of the present invention to provide a display apparatus and backlight drive method that improve the visibility of a moving image and increase the light adjustment range.

SUMMARY

According to a first aspect of the present invention, provided is A display apparatus comprising a display panel; a rewriting section that rewrites an image displayed on a screen of the display panel with a prescribed period; a backlight used by the display panel to adjust luminance of the screen according to an arbitrary adjustment value; and a drive control section that controls an amount of drive current supplied to the backlight during a drive time period, during which the backlight is driven, and a length of the drive time period of the drive current, repeatedly in synchronization with the prescribed period that is also a period with which the drive time period and a rest time period, during which driving is stopped, alternate. The rewriting section writes a frame of the same image twice during the prescribed period, the drive control section causes the drive time period to be included in a time period during which different images are not mixed together in a single frame, and causes a time period in which different images are mixed together in a single frame to be included in the rest time period; the drive control section sets the rest time period to be a prescribed time period for a range in which the adjustment value is less than a prescribed value, and sets the rest time period to be shorter than the prescribed time period for a range in which the adjustment value is greater than the prescribed value; and the drive control section increases or decreases an integrated value of the drive current according to the adjustment value.

According to a second aspect of the present invention, in the display apparatus of the first aspect, the drive control section causes the drive current to be constant for a range in which the adjustment value is greater than the prescribed value.

According to a third aspect of the present invention, in the display apparatus of the first or second aspect, the prescribed value is set according to the prescribed time period and an upper limit value of the drive current supplied to the backlight.

According to a fourth aspect of the present invention, provided is a backlight drive method performed by a display apparatus that includes a display panel in which an image displayed on a screen of the display panel is rewritten with a prescribed period and a backlight used by the display panel to adjust luminance of the screen according to an arbitrary adjustment value. The method comprises controlling an amount of drive current supplied to the backlight during a drive time period, during which the backlight is driven, and a length of the drive time period of the drive current, repeatedly in synchronization with the prescribed period that is also a period with which the drive time period and a rest time period, during which driving is stopped, alternate. The display panel writes a frame of the same image twice during the prescribed period; the controlling includes causing the drive time period to be included in a time period during which different images are not mixed together in a single frame, and causing a time period in which different images are mixed together in a single frame to be included in the rest time period; the controlling includes setting the rest time period to be a prescribed time period for a range in which the adjustment value is less than a prescribed value, and setting the rest time period to be shorter than the prescribed time period for a range in which the adjustment value is greater than the prescribed value; and the controlling includes increasing or decreasing an integrated value of the drive current according to the adjustment value.

In the first aspect and the fourth aspect, the drive control section controls the length of the drive time period of the drive current that causes the drive time period during which the backlight is driven and the rest time period during which the driving is stopped to repeatedly alternate, in synchronization with the rewriting period of the display panel. The period of the drive current is in synchronization with the rewriting period of the display panel. The drive current is a pulse signal that undergoes PWM control, for example, the drive time period corresponds to the pulse width of the pulse signal, and the rest time period is the time period between adjacent pulse signals. In other words, the backlight lights up during the drive time period, and the backlight does not emit light during the rest time period. The length of the drive time period is the length of the pulse width of the pulse signal, and shortening or lengthening the drive time period is equivalent to decreasing or increasing the duty ratio of the PWM control. By lengthening the drive time period of the drive current, i.e. by increasing the duty ratio of the drive signal, the amount of light emitted by the backlight increases and the luminance of the display panel becomes higher.

The drive control section controls the amount of drive current supplied to the backlight during the drive time period. For example, when the drive current has a prescribed duty ratio, by increasing the amount of drive current during the drive time period, it is possible to increase the amount of light emitted by the backlight and cause the luminance of the display panel to be higher. Furthermore, by decreasing the amount of drive current during the drive time period, it is possible to decrease the amount of light emitted by the backlight and cause the luminance of the display panel to be lower.

In a range where the adjustment value is lower than the prescribed value, the drive control section sets the rest time period to be a prescribed period and increases or decreases the integrated value of the drive current according to the adjustment value. Setting the rest time period to a prescribed time period refers to fixing the duty ratio of the drive current to a desired value, for example. By fixing the duty ratio of the drive current at a desired value, even when a moving image is displayed on the screen, the visibility of the moving image can be improved and the occurrence of flickering or the like can be restricted. The adjustment value is a brightness adjustment value, for example, and by increasing or decreasing the integrated value of the drive current according to the brightness level, it is possible to adjust (control) the luminance of the display panel.

On the other hand, in a range where the adjustment value is higher than the prescribed value, the drive control section causes the rest time period to be shorter than the prescribed time period. By causing the rest time period to be shorter than the prescribed time period, the time period during which the drive current flows is lengthened without increasing the drive current, and therefore it is possible to increase the amount of light emitted by the backlight and increase the luminance of the display panel. In this way, it is possible to further increase the luminance of the display panel in a range where the adjustment value is higher than the prescribed value, and to expand the light adjustment range of the display panel.

In the second aspect, the drive control section sets the drive current to be constant in a range where the adjustment value is greater than the prescribed value. In other words, the drive time period of the drive signal is shortened or lengthened in the range where the adjustment value is higher than the prescribed value, and therefore it is possible to keep the drive current constant without being increased. Therefore, even when it is impossible to increase the drive current, it is still possible to further increase the luminance of the display panel in a range where the adjustment value is higher than the prescribed value, and to expand the light adjustment range of the display panel.

In the third aspect, the prescribed value is set according to the prescribed time period and the upper limit value of the drive current supplied to the backlight. Therefore, in the range where the drive current is less than the upper limit value (the range where the luminance is less than the prescribed value), it is possible to fix the drive time period of the drive current, improve the visibility of the moving image, restrict the occurrence of flickering or the like, and enable light adjustment by increasing or decreasing the drive current. Furthermore, in the range where the drive current has reached the upper limit value (the range where the luminance is greater than the prescribed value), by fixing the drive current at the upper limit value and shortening the rest time period of the drive current (or lengthening the drive time period of the drive current), it is possible to improve the visibility of the moving image and expand the light adjustment range to include higher luminance.

With the present embodiment, it is possible to improve the visibility of a moving image and increase the light adjustment range.

DESCRIPTION OF EXEMPLARY EMBODIMENTS

Figure 1:
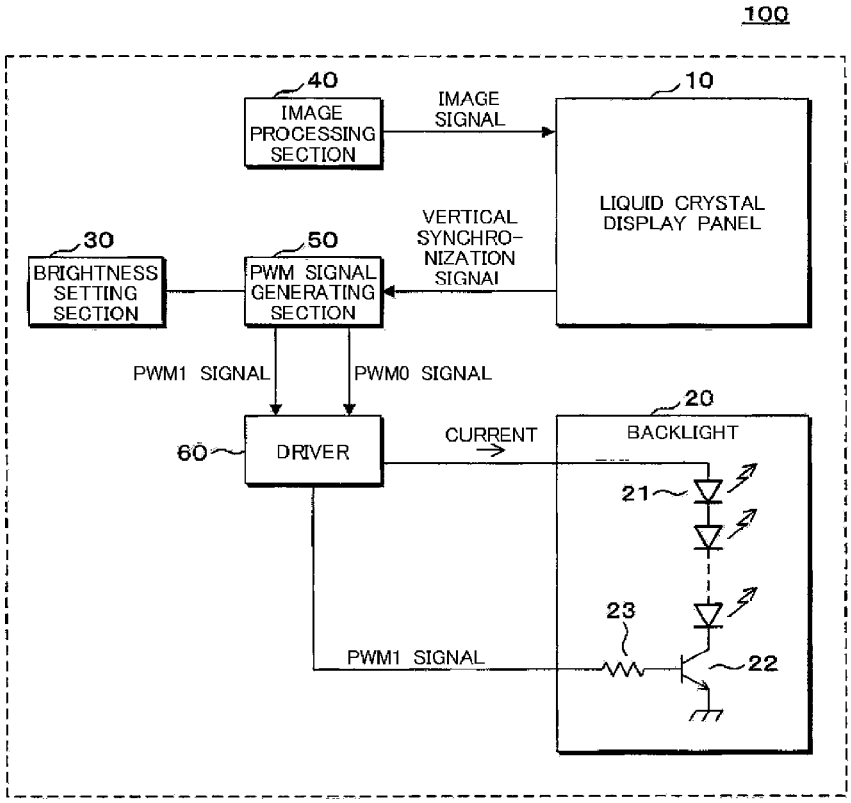
FIG. 1 is a block diagram showing an exemplary configuration of a display apparatus according to an embodiment of the present invention.

The following describes a display apparatus and a backlight drive method according to the present invention, based on drawings showing embodiments. FIG. 1 is a block diagram showing an exemplary configuration of a display apparatus 100 according to an embodiment of the present invention. The display apparatus 100 includes an LCD panel 10 serving as a display panel, a backlight 20 arranged on the back surface of the LCD panel 10, a brightness setting section 30, an image processing section 40, a PWM signal generating section 50, and a driver 60. The display panel is not limited to being liquid crystal, and may be a display panel formed from another light blocking material.

The backlight 20 includes plurality of LEDs 21 arranged in series, a transistor 22 that serves as a switching element for switching the current flowing through each LED 21 (the drive current) ON and OFF, a bias resistance 23 for limiting the current flowing through the base of the transistor 22 to be a suitable value, and the like. The example of FIG. 1 shows a configuration in which a plurality of LEDs 21 are connected in series, but the number of LEDs 21 and the connection state of the LEDs 21 are not limited to this example.

The image processing section 40 reads image data acquired from an external apparatus or image data stored in a recording apparatus (not shown), for example, and outputs an image signal for each single frame to the LCD panel 10. In the present embodiment, the image signal is referred to as a video signal. The time period of a single frame is a rewrite period during which the LCD panel 10 rewrites the image of one frame displayed on the screen, and is the same as a time period of the vertical synchronization signal of the LCD panel 10. The time period of a single frame, i.e. the period of a vertical synchronization signal, is 120 Hz, for example, but is not limited to this value and may instead be 60 Hz, 240 Hz, or the like.

The LCD panel 10 outputs the vertical synchronization signal to the PWM signal generating section 50. The example of FIG. 1 shows a configuration in which the LCD panel 10 outputs the vertical synchronization signal, but the present invention is not limited to this, and in a case where a display control section (not shown) that performs display control for the LCD panel 10 is provided separately from the LCD panel 10, this display control section may output the vertical synchronization signal.

Figure 2:
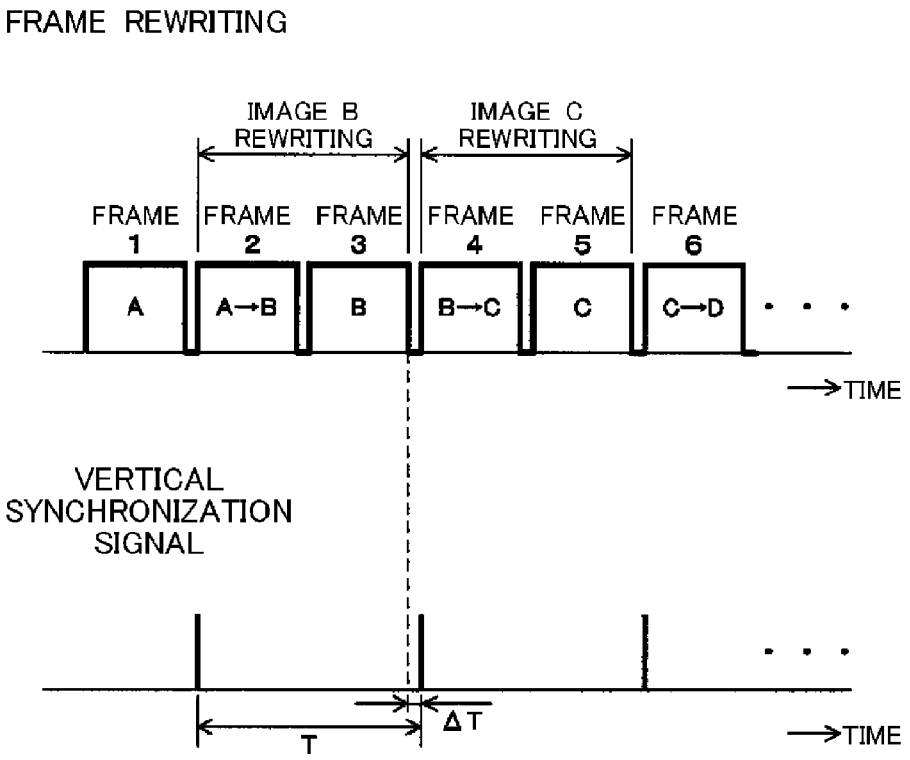
FIG. 2 is a descriptive drawing showing an exemplary frame rewrite of the display apparatus according to the present embodiment.

FIG. 2 is a descriptive drawing showing an exemplary frame rewrite of the display apparatus 100 according to the present embodiment. The upper portion of FIG. 2 shows a rewrite state of a frame (an image of one frame), and the lower portion shows the timing of the vertical synchronization signal. As shown in FIG. 2, the vertical synchronization signal is repeatedly output with a prescribed rewrite period T. In the present embodiment, the rewrite period T is 120 Hz, and the single frame time period is approximately 8.3 ms. The rewrite period T is not limited to 120 Hz, and may instead be 60 Hz, 240 Hz, or the like.

The LCD panel 10 writes a frame of the same image two times during the rewrite period T. For example, for convenience, FIG. 2 shows frames 1 to 6 in time sequence, and frame 1 corresponds to image A. The LCD panel 10 writes the same image B to frame 2 and frame 3.

In frame 2, image A written in frame 1 still remains, and therefore image A is gradually rewritten to become image B. At the time when frame 2 ends, image B has been written. In frame 3, image B is written again, and therefore only image B is displayed. Actually, a process of rewriting image B with image B is performed here.

There is a small time difference (time shift) ΔT between the point of time when the writing of image B in frame 3 ends and the point of time when a next vertical synchronization signal is output. This time difference ΔT is a time difference caused by internal processing, and is approximately 1 ms, for example. The period T of the vertical synchronization signal is 120 Hz, and the time between vertical synchronization signals is approximately 8.3 ms. Within the LCD panel 10, writing is performed at 240 Hz, which is twice the period T.

In the same manner, in frame 4, image B written in frame 3 still remains, and therefore image B is gradually rewritten to become image C. At the time when frame 4 ends, image C has been written. In frame 5, image C is written again, and therefore only image C is displayed. Actually, a process of rewriting image C with image C is performed here.

In frame 6, image C written in frame 5 still remains, and therefore image C is gradually rewritten to become image D. The following process is performed in the same manner.

The brightness setting section 30 has a function to adjust the luminance of the LCD panel 10, and can set the luminance of the screen of the LCD panel 10 to have a brightness adjustment value in a range from 0% to 100%, for example. The brightness setting section 30 may be a knob such as used for volume (not shown) provided to the display apparatus 100, or may be a setting screen that is displayed on the screen of the display apparatus 100. The display apparatus 100 may perform the setting automatically, without input from the user. Instead, the setting may be performed from an information device such as a computer outside of the display apparatus 100, via a communication interface such as a USB. The brightness setting section 30 outputs the brightness adjustment value to the PWM signal generating section 50 as a set adjustment value.

The PWM signal generating section 50 functions as a drive control section, and controls the length of the drive time period of the drive current to repeatedly alternate between a drive time period during which the backlight 20 is driven and a rest time period during which the driving is stopped, in synchronization with the rewrite period T of the LCD panel 10. In the example of FIG. 1, the PWM1 signal corresponds to the drive current. The PWM signal generating section 50 outputs the PWM1 signal to the driver 60.

The period of the PWM1 signal is in synchronization with the rewrite period T of the LCD panel 10. In the present embodiment, the period of the PWM1 signal is 120 Hz. The PWM1 signal is a pulse signal that undergoes PWM control, in which the drive time period (ON time period) corresponds to the pulse width of the pulse signal and the rest time period (OFF time period) is the time period between adjacent pulse signals. In other words, the backlight 20 lights up during the drive time period, and the backlight 20 does not emit light during the rest time period. The length of the drive time period is the length of the pulse width of the PWM1 signal, and shortening or lengthening the drive time period is equivalent to decreasing or increasing the duty ratio of the PWM control. By lengthening the drive time period (shortening the rest time period) of the PWM1 signal, i.e. by increasing the duty ratio of the PWM1 signal, the amount of light emitted by the backlight 20 increases and the luminance of the LCD panel 10 becomes higher.

The PWM signal generating section 50 functions as a drive control section, and controls the amount of drive current supplied to the backlight 20 during the drive time period (ON time period). For example, when the PWM1 signal has a prescribed duty ratio, by increasing the amount of drive current during the drive time period, it is possible to increase the amount of light emitted by the backlight 20 and cause the luminance of the LCD panel 10 to be higher. Furthermore, by decreasing the amount of drive current during the drive time period, it is possible to decrease the amount of light emitted by the backlight 20 and cause the luminance of the LCD panel 10 to be lower.

More specifically, the PWM signal generating section 50 outputs to the driver 60 a PWM0 signal for increasing or decreasing the drive current. The PWM0 signal is a pulse signal that undergoes PWM control and has a period of approximately 18 kHz, for example, in which the duty ratio pf the PWM0 signal becomes larger when the drive current supplied to the backlight 20 is increased and the duty ratio pf the PWM0 signal becomes smaller when the drive current supplied to the backlight 20 is decreased.

The driver 60 has a so-called signal conversion function. The driver 60 outputs the PWM1 signal output from the PWM signal generating section 50 as-is to the base of the transistor 22 of the backlight 20, or performs amplification, impedance conversion, or the like on the PWM1 signal output from the PWM signal generating section 50 and outputs the resulting signal to the base of the transistor 22 of the backlight 20. With this configuration, during the drive time period (ON time period) of the PWM1 signal, the transistor 22 is ON, current (drive current) flows through the LED 21, and the backlight 20 lights up. On the other hand, during the rest time period (OFF time period) of the PWM1 signal, the transistor 22 is OFF and current (drive current) does not flow through the LED 21, and therefore the backlight 20 does not emit light.

The driver 60 includes a low-pass filter, a power supply section, and the like, converts the PWM0 signal output by the PWM signal generating section 50 into DC voltage using the low-pass filter, and controls the amount of drive current output to the backlight 20 according to the magnitude of the DC voltage resulting from the conversion. In other words, when the duty ratio of the PWM0 signal is larger, the DC voltage resulting from the conversion by the low-pass filter is higher and more drive current is supplied to the backlight 20 by the driver 60. As described further below, the amount of light of the backlight is determined by the integrated value of the drive current, and therefore a conversion to DC voltage is not absolutely necessary, and the backlight 20 may be driven by the unaltered PWM signal.

Figure 3A:
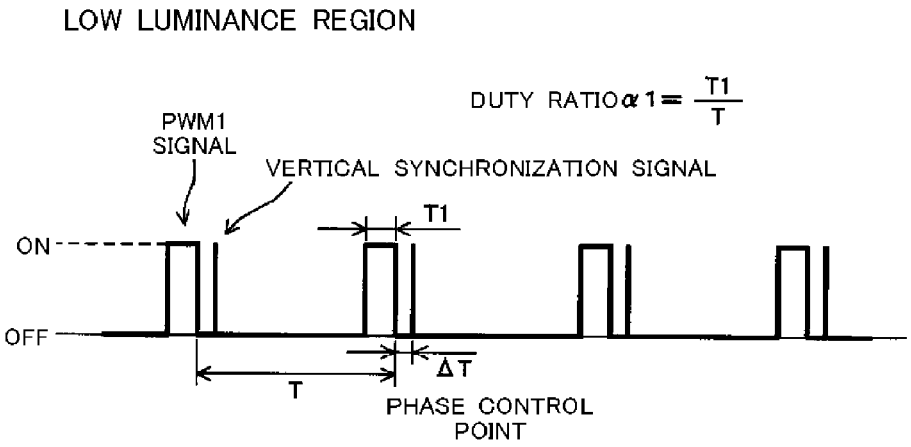
FIGS. 3A and 3B are time charts showing exemplary drive time period control performed by the display apparatus according to the present embodiment.
Figure 3B:
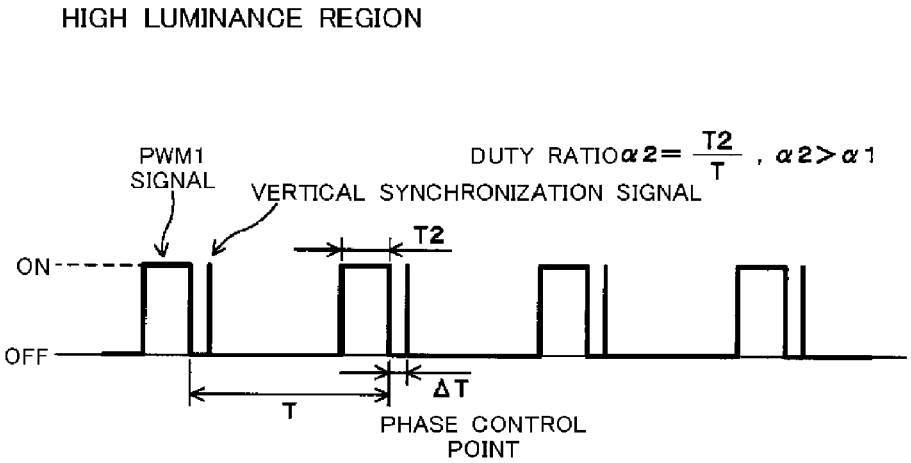

FIGS. 3A and 3B are time charts showing exemplary drive time period control performed by the display apparatus 100 according to the present embodiment. The drive time period control is control for driving the backlight 20 by changing the duty ratio of the PWM1 signal. FIG. 3A shows the low luminance region, and FIG. 3B shows the high luminance region. The low luminance region refers to a range in which the brightness adjustment value is less than a prescribed value, and the high luminance region refers to a range in which the brightness adjustment value is greater than the prescribed value. The prescribed value can be set to correspond to an upper limit value for the drive current supplied to the backlight 20, for example. Specifically, the low luminance region is a region in which the drive current supplied to the backlight 20 is less than the upper limit value, and the high luminance region is a region in which the drive current supplied to the backlight 20 has reached the upper limit value.

The PWM1 signal is in synchronization with the period T of the vertical synchronization signal. The phase control point for synchronizing the PWM1 signal with the vertical synchronization signal is a point in time that is the time difference ΔT (approximately 1 ms, for example) earlier than the vertical synchronization signal, and phase control (synchronization control) is performed by changing the duty ratio while maintaining this time difference ΔT.

As shown in FIG. 3A, when the drive time period (pulse width and ON time period) of the PWM1 signal is T1, the duty ratio al can be expressed as $\alpha 1=T1/T$. As shown in FIG. 3B, in the high luminance region, when the drive time period (pulse width and ON time period) of the PWM1 signal is T2, the duty ratio $\alpha 2$ can be expressed as $\alpha 2=T2/T$ ($\alpha 2>\alpha 1$).

As shown in FIGS. 3A and 3B, the PWM1 signal changes the duty ratio while the phase control point is maintained. Therefore, the timing at which the frame image is rewritten twice with the same image is during the drive time period (ON time period) of the PWM1 signal, as shown in FIG. 2, and therefore it is impossible for different images to be mixed together in one frame. Furthermore, different images are mixed together in a single frame during the rest time period (OFF time period) of the PWM1 signal. In other words, each frame in which different images are mixed together occurs during the rest time period (OFF time period) of the PWM1 signal, which is the time during which the backlight 20 does not emit light, and therefore the state in which different images are mixed together is not visible. Furthermore, different images are not mixed together during the time period in which the backlight 20 does not emit light, and therefore blurring, overlap, and the like of the video can be eliminated, thereby improving the visibility of the moving image. In the above description, the synchronization control of the drive time period is performed while maintaining the time difference ΔT, but the present invention is not limited to this, and it is only necessary that the drive time period occur during the second rewrite time period in which different images are not mixed. For example, phase control may be performed using the start time of the second rewrite time period as a reference, or the phase may be randomly or regularly moved within the second rewrite time period.

Figure 4A:
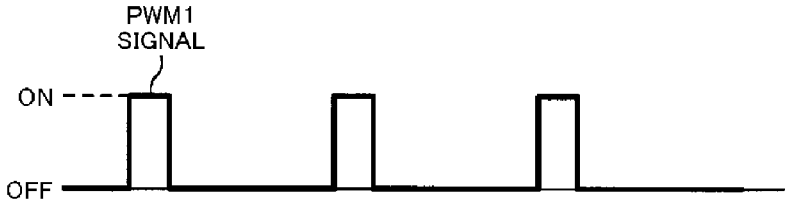
FIGS. 4A to 4C are time charts showing an example of the drive current control performed by the display apparatus according to the present embodiment.
Figure 4B:
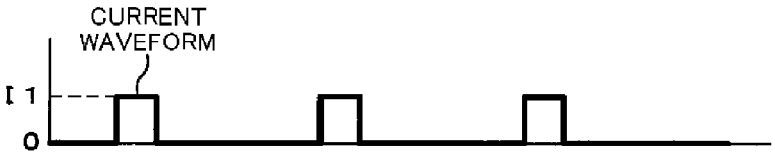
Figure 4C:
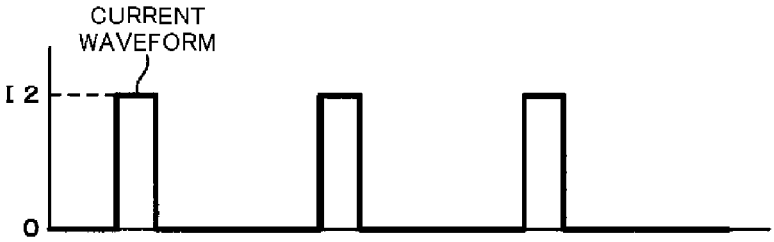

FIGS. 4A to 4C are time charts showing an example of the drive current control performed by the display apparatus 100 according to the present embodiment. The drive current control is control for increasing or decreasing the drive current supplied to the backlight 20 by changing the duty ratio of the PWM0 signal. FIG. 4A shows the PWM1 signal, FIG. 4B shows a case in which the drive current is relatively small, and FIG. 4C shows a case in which the drive current is relatively large. In FIGS. 4A to 4C, the current waveforms are shown schematically as rectangular waveforms, for ease of explanation.

As shown in FIG. 4B, the peak value of the current waveform supplied to the backlight 20 during the drive time period (ON time period) of the PWM1 signal is I1. As shown in FIG. 4C, the peak value of the current waveform supplied to the backlight 20 during the drive time period (ON time period) of the PWM1 signal is I2. By changing the peak value of a current waveform, it is possible to control the amount of drive current.

The luminance is determined by the integrated value of the current waveform used for driving, and therefore not only may the drive current be changed to have a constant peak value, the drive current may also be changed to raise or lower the peak values within the drive time period. The change amount and change timing for the peak value may be set as desired through visual checking or the like.

Figure 5:
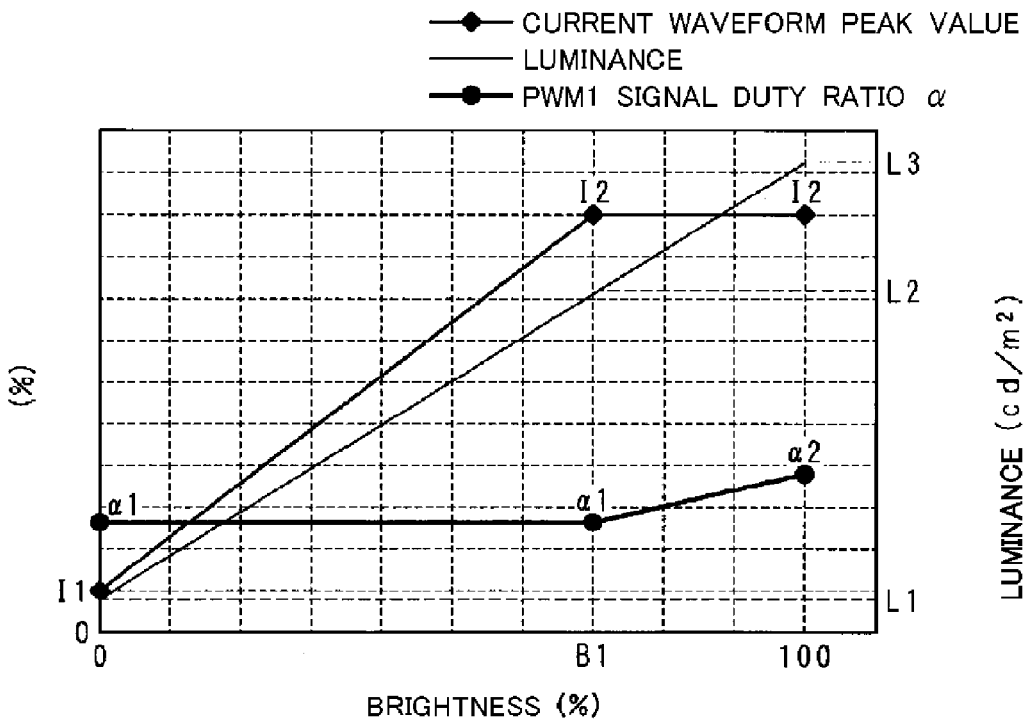
FIG. 5 is a descriptive drawing showing a first example of a drive method of the backlight performed by the display apparatus according to the present embodiment.

The following describes a drive method of the backlight 20 performed by the display apparatus 100 according to the present embodiment. FIG. 5 is a descriptive drawing showing a first example of a drive method of the backlight 20 performed by the display apparatus 100 according to the present embodiment. In FIG. 5, the horizontal axis indicates the brightness adjustment value set for the brightness setting section 30. The vertical axis on the left side indicates percentages (%) of the duty ratio of the PWM1 signal and the peak value (drive current value) of the current waveform of the drive current supplied to the backlight 20. A peak value of 100% represents the upper limit (allowable range) for current flow that enables circuit operation. The vertical axis on the right side indicates the luminance of the LCD panel 10.

As shown in FIG. 5, in the range where the brightness adjustment value is less than the prescribed value (the range where the brightness adjustment value is from 0% to B1% in the example of FIG. 5), the PWM signal generating section 50 sets the drive time period (or the rest time period) to be a prescribed time period. Specifically, the PWM signal generating section 50 fixes the duty ratio at a desired value (a value of $\alpha 1\%$ in the example of FIG. 5). The duty ratio is set to a value that optimizes the visibility of the moving image through visual checking, and differs according to the panel characteristics and circuit capabilities. At the same time, the PWM signal generating section 50 increases or decreases the drive current (the drive current is from I1% to I2% in the example of FIG. 5) by changing the peak value of the drive current according to the brightness adjustment value (greater than or equal to 0% and less than or equal to B1% in the example of FIG. 5). By fixing the duty ratio of the PWM1 signal as a desired value, even when a moving image is displayed on the screen, the visibility of the moving image can be improved and the occurrence of flickering or the like can be restricted. By increasing or decreasing the drive current according to the brightness level, it is possible to adjust (control) the luminance of the LCD panel 10. As described above, the drive current may be adjusted according to the integrated change using the rest time period, regardless of the peak values.

In the range where the brightness adjustment value is greater than the prescribed value (the range where the brightness adjustment value is greater than B1% and less than or equal to 100% in the example of FIG. 5), it is impossible to increase the light amount using only the drive current because the drive current reaches the upper limit of 100%, and therefore the PWM signal generating section 50 causes the drive time period to be longer than a prescribed time period (or causes the rest time period to be shorter than a prescribed time period). Specifically, the PWM signal generating section 50 causes the duty ratio of the PWM1 signal to be greater than the desired value (α1%). By causing the drive time period to be longer than the prescribed time period, the time period during which the drive current flows is lengthened without increasing the drive current, and therefore it is possible to increase the amount of light emitted by the backlight 20 and increase the luminance of the LCD panel 10. In this way, it is possible to further increase the luminance of the LCD panel 10 in a range where the brightness adjustment value is higher than the prescribed value, and to expand the light adjustment range of the LCD panel 10.

More specifically, in the range where the brightness adjustment value is higher than the prescribed value (a range in which the brightness adjustment value is greater than B1% and less than or equal to 100% in the example of FIG. 5), the PWM signal generating section 50 shortens or lengthens the drive time period according to the magnitude of the brightness adjustment value. In the example of FIG. 5, when the brightness adjustment value increases from B1% to 100%, the duty ratio of the PWM1 signal increases from α1% to α2%.

In the range where the brightness adjustment value is greater than or equal to 0% and less than B1%, by fixing the duty ratio of the PWM1 signal at α1% and increasing the drive current from I1% to I2%, the luminance of the LCD panel 10 increases from L1 [cd/m2] to L2 [cd/m2]. Furthermore, in the range where the brightness adjustment value is from B1% to 100%, by fixing the drive current at I2% and changing the duty ratio of the PWM1 signal from α1% to α2%, the luminance of the LCD panel 10 increases from L2 [cd/m2] to L3 [cd/m2].

In this way, with a configuration in which the duty ratio of the PWM signal is fixed and the drive current is increased, as shown in the example of FIG. 5, the maximum luminance of the LCD panel 10 is L2 [cd/m2], and a luminance greater than this cannot be realized. However, by maintaining the drive current at 100% and increasing the duty ratio of the PWM1 signal according to the magnitude of the brightness adjustment value, such as in the present embodiment, it is possible to increase the maximum luminance to L3 [cd/m2] and to expand the light adjustment range of the high luminance region. Through experimentation performed by the inventor, it was found that the maximum luminance can be increased by approximately 30% using the present embodiment.

As understood from FIG. 5, it is possible to linearize the change percentage of the luminance in the range where the brightness adjustment value is greater than or equal to 0% and less than or equal to B1% and in the range where the brightness adjustment value is greater than B1% and less than or equal to 100%. In this way, by setting the percentage of the change in the luminance of the LCD panel 10 in a case where the drive current is increased or decreased according to the magnitude of the brightness in the range where the brightness adjustment value is less than the prescribed value to be equal to the percentage of the change in the luminance of the LCD panel 10 in a case where the drive time period is increased or decreased according to the magnitude of the brightness adjustment value in the range where the brightness adjustment value is greater than the prescribed value, it is possible to realize light adjustment that is the same (linear) in the range where the brightness adjustment value is greater than the prescribed value and the range where the brightness adjustment value is less than the prescribed value.

The PWM signal generating section 50 sets the drive current to be constant (I2%) in the range where the brightness adjustment value is greater than B1% and less than or equal to 100%. In other words, in the range where the brightness adjustment value is greater than the prescribed value, the drive time period of the drive current is increased or decreased according to the magnitude of the brightness adjustment value, and therefore it is possible to keep the drive current constant without any increase. Therefore, even in a case where the drive current has reached the upper limit for a circuit, it is possible to further increase the luminance of the LCD panel 10 and to expand the light adjustment range of the LCD panel 10.

The prescribed value used to separate the luminance of the screen into high luminance and low luminance (the brightness adjustment value B1% in the example of FIG. 5) is set according to the upper limit value of the drive current supplied to the backlight 20. Therefore, in the range where the drive current is less than the upper limit value (the range where the luminance is less than the prescribed value), it is possible to fix the drive time period of the drive signal, improve the visibility of the moving image, restrict the occurrence of flickering or the like, and enable light adjustment by increasing or decreasing the drive current. Furthermore, in the range where the drive current has reached the upper limit value (the range where the luminance is greater than the prescribed value), by fixing the drive current at the upper limit value and lengthening the drive time period of the drive signal, it is possible to improve the visibility of the moving image and expand the light adjustment range to include higher luminance. With the present embodiment, a distinction is made by which the range where the brightness adjustment value is greater than or equal to 0% and less than or equal to B1% is low luminance and the range where the brightness adjustment value is greater than B1% and less than or equal to 100% is high luminance, but the present invention is not limited to this, and the distinction may be made such that a range where the brightness adjustment value is greater than or equal to 0% and less than B1% is low luminance and a range where the brightness adjustment value is greater than or equal to B1% and less than or equal to 100% is high luminance.

Figure 6:
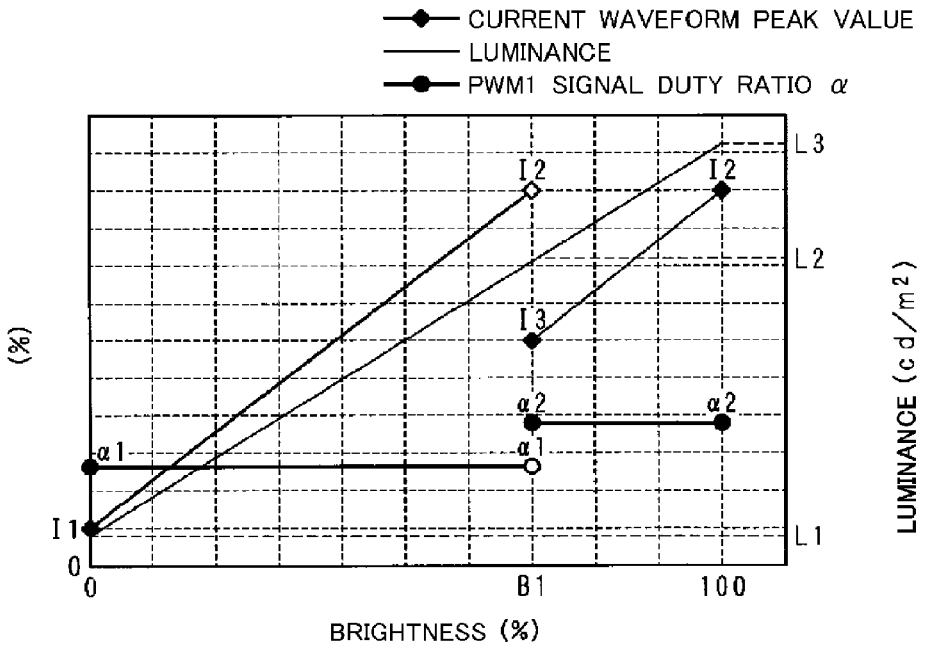
FIG. 6 is a descriptive drawing showing a second example of a drive method of the backlight performed by the display apparatus according to the present embodiment.

FIG. 6 is a descriptive drawing showing a second example of a drive method of the backlight 20 performed by the display apparatus 100 according to the present embodiment. In the example of FIG. 5 described above, in the range where the adjustment value is higher than the prescribed value (where the brightness adjustment value is higher than B1%), the drive current is fixed and the drive time period is increased or decreased according to the brightness adjustment value, but the present invention is not limited to this. As shown in FIG. 6, in the range where the adjustment value is higher than the prescribed value (where the brightness adjustment value is higher than B1%), the drive time period may be fixed (a duty ratio of α2 in the example of FIG. 6)

and the drive current may be increased or decreased (a drive current from I3% to I2% in the example of FIG. 6) according to the brightness adjustment value. In this case, in the same manner as shown in FIG. 5, the luminance increases from L1 to L2 in the range where the brightness adjustment value is greater than or equal to 0% and less than or equal to B1%, and the luminance increases from L2 to L3 in the range where the brightness adjustment value is greater than B1% and less than or equal to 100%. The present invention is not limited to the above, and a drive method may be used for a range where the brightness adjustment value is greater than or equal to 0% and less than B1% and a range where the brightness adjustment value is greater than or equal to B1% and less than or equal to 100%.

Figure 7:
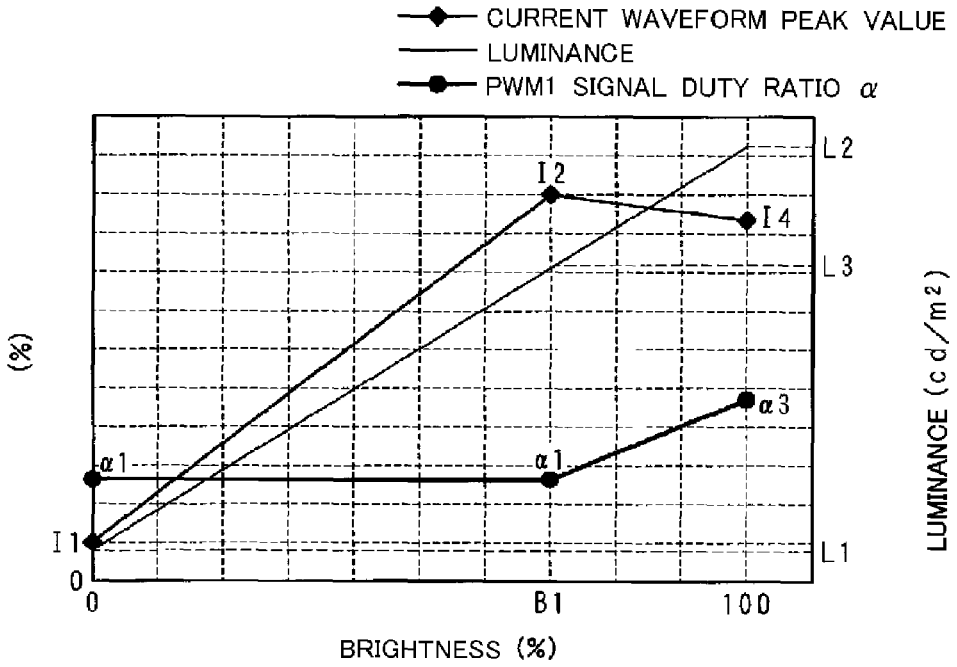
FIG. 7 is a descriptive drawing showing a third example of a drive method of the backlight performed by the display apparatus according to the present embodiment.

FIG. 7 is a descriptive drawing showing a third example of a drive method of the backlight 20 performed by the display apparatus 100 according to the present embodiment. In the example of FIG. 7, instead of fixing one of the drive current and the drive time period, both the drive current and the drive time period are changed to obtain a desired luminance. The third example shown in FIG. 7 is especially useful as a drive method that takes into consideration the temperature characteristics of the LED 21. In a LED 21, it is known that the rated current decreases in response to an increase in the surrounding temperature. When the drive time period is increased for high luminance, the amount of heat generated by the LED 21 increases, which may lead to an increase in the surrounding temperature. Therefore, as shown in FIG. 7, driving may be performed while lowering the current to draw near the drive current I4 which is commensurate with the increased temperature assumed and lengthening the drive time period toward $\alpha 3$ ($>\alpha 2$) in a manner to increase the luminance linearly.

In the embodiments described above, in the low luminance region where the brightness adjustment value is from 0% to B1%, the duty ratio of the PWM1 signal is set to $\alpha 1\%$, but the duty ratio is not limited to $\alpha 1\%$. Furthermore, in the high luminance region where the brightness adjustment value is from B1% to 100%, the duty ratio of the PWM1 signal is set to be from $\alpha 1\%$ to $\alpha 2\%$, but the duty ratio is not limited to being these values. For example, in the low luminance region where the brightness adjustment value is from 0% to B1%, the duty ratio can be set to be from $\alpha 1\%$ to $\alpha 2\%$, and in the high luminance region where the brightness adjustment value is from B1% to 100%, the duty ratio can be set to be from $\alpha 2\%$ to 50%. When the duty ratio is less than $\alpha 1\%$, flickering and the like becomes apparent. Furthermore, when the duty ratio is greater than 50%, the backlight 20 lights up during a portion of a frame in which different images are mixed together, and this degrades the visibility of the moving image.

In the embodiments described above, the prescribed value of brightness for distinguishing between the low luminance region and the high luminance region is set as B1%, but this prescribed value is not limited to B1%. It is possible to set the brightness value causing the drive current to be the upper limit value as the prescribed value when the brightness is increased from 0%, according to the specifications of the power supply section of the driver 60, the forward rated current of the LEDs forming the backlight 20, and the like.

LIST OF REFERENCE NUMERALS

10: LCD panel, 20: backlight, 30: brightness setting section, 40: image processing section, 50: PWM signal generating section, 60: driver

What is claimed is:

1. A display apparatus comprising:

a display panel;

a rewriting section that rewrites an image displayed on a screen of the display panel with a prescribed period;

a backlight used by the display panel to adjust luminance of the screen according to an arbitrary adjustment value; and a drive control section that controls an amount of drive current supplied to the backlight during a drive time period, during which the backlight is driven, and a length of the drive time period of the drive current, repeatedly in synchronization with the prescribed period that is also a period with which the drive time period and a rest time period, during which the drive current is stopped, alternate, wherein the rewriting section writes a frame of a same image twice during the prescribed period, the drive control section causes the drive time period to be included in a time period during which different images are not mixed together in a single frame, and causes the rest time period in which different images are mixed together in a single frame to be included in the rest time period, the prescribed period is a period of a vertical synchronization signal of the display panel, the drive control section, at a phase control point for synchronizing a PWM signal corresponding to the drive current with the vertical synchronization signal, which is a time that is earlier than the vertical synchronization signal by a prescribed time difference, controls an amount of the drive current and a length of the drive time period that repeats in synchronization with the prescribed period with which the drive time period and the rest time period alternate, and luminance of the display is continuously increasable by the drive control section by causing, in a lower brightness range, the drive current to be set to any level below a maximum prescribed current value during the drive time period up to a given brightness while maintaining the PWM signal constant, and above the given brightness by causing the drive current to be maintained at the maximum prescribed current value while increasing the PWM signal to generate an increasable extended drive time period longer than the drive time period.

2. The display apparatus according to claim 1, wherein the drive control section causes the drive current to be constant for a range in which the adjustment value is greater than the prescribed value.

3. The display apparatus according to claim 1, wherein the prescribed value is set according to the prescribed drive time period and the maximum prescribed current value of the drive current supplied to the backlight.

4. A backlight drive method performed by a display apparatus that includes a display panel in which an image displayed on a screen of the display panel is rewritten with a prescribed period and a backlight used by the display panel to adjust luminance of the screen according to an arbitrary adjustment value, the method comprising:

controlling an amount of drive current supplied to the backlight during a drive time period, during which the backlight is driven, and a length of the drive time period of the drive current, repeatedly in synchronization with the prescribed period that is also a period with which the drive time period and a rest time period, during which driving is stopped, alternate, wherein the display panel writes a frame of a same image twice during the prescribed period, the controlling includes causing the drive time period to be included in a time period during which different images are not mixed together in a single frame, and causing the rest time period in which different images are mixed together in a single frame to be included in the rest time period, the prescribed period is a period of a vertical synchronization signal of the display panel, the drive control section, at a phase control point for synchronizing a PWM signal corresponding to the drive current with the vertical synchronization signal, which is a time that is earlier than the vertical synchronization signal by a prescribed time difference, controls an amount of the drive current and a length of the drive time period that repeats in synchronization with the prescribed period with which the drive time period and the rest time period alternate, and luminance of the display is continuously increasable by the drive control section by causing, in a lower brightness range, the drive current to be set to any level below a maximum prescribed current value during the drive time period up to a given brightness while maintaining the PWM signal constant, and above the given brightness by causing the drive current to be maintained at the maximum prescribed current value while increasing the PWM signal to generate an increasable extended drive time period longer than the drive time period.

5. A display apparatus comprising:

a display panel;

a rewriting section that rewrites an image displayed on a screen of the display panel with a prescribed period;

a backlight used by the display panel to adjust luminance of the screen according to an arbitrary adjustment value; and a drive control section that controls an amount of drive current supplied to the backlight during a drive time period, during which the backlight is driven, and a length of the drive time period of the drive current, repeatedly in synchronization with the prescribed period that is also a period with which the drive time period and a rest time period, during which the drive current is stopped, alternate, wherein the rewriting section writes a frame of a same image twice during the prescribed period, the drive control section causes the drive time period to be included in a time period during which different images are not mixed together in a single frame, and causes the rest time period in which different images are mixed together in a single frame to be included in the rest time period, the prescribed period is a period of a vertical synchronization signal of the display panel, the drive control section, at a phase control point for synchronizing a PWM signal corresponding to the drive current with the vertical synchronization signal, which is a time that is earlier than the vertical synchronization signal by a prescribed time difference, controls an amount of the drive current and a length of the drive time period that repeats in synchronization with the prescribed period with which the drive time period and the rest time period alternate, and luminance of the display is continuously increasable by the drive control section by causing, at a lower brightness range, the drive current to be set to any level below a maximum prescribed current value during the drive time period up to a given brightness while maintaining the PWM signal constant, and above the given brightness by causing the drive current to be increasable from a level below the maximum prescribed current value to any level up to the maximum prescribed current value while maintaining the PWM signal to generate a fixed extended drive time period longer than the drive time period.

6. The display apparatus according to claim 5, wherein the prescribed value is set according to the prescribed drive time period and the maximum prescribed current value of the drive current supplied to the backlight.

7. A backlight drive method performed by a display apparatus that includes a display panel in which an image displayed on a screen of the display panel is rewritten with a prescribed period and a backlight used by the display panel to adjust luminance of the screen according to an arbitrary adjustment value, the method comprising:

controlling an amount of drive current supplied to the backlight during a drive time period, during which the backlight is driven, and a length of the drive time period of the drive current, repeatedly in synchronization with the prescribed period that is also a period with which the drive time period and a rest time period, during which driving is stopped, alternate, wherein the display panel writes a frame of a same image twice during the prescribed period, the controlling includes causing the drive time period to be included in a time period during which different images are not mixed together in a single frame, and causing the rest time period in which different images are mixed together in a single frame to be included in the rest time period, the prescribed period is a period of a vertical synchronization signal of the display panel, the drive control section, at a phase control point for synchronizing a PWM signal corresponding to the drive current with the vertical synchronization signal, which is a time that is earlier than the vertical synchronization signal by a prescribed time difference, controls an amount of the drive current and a length of the drive time period that repeats in synchronization with the prescribed period with which the drive time period and the rest time period alternate, and luminance of the display is continuously increasable by the drive control section by causing, at a lower brightness range, the drive current to be set to any level below a maximum prescribed current value during the drive time period up to a given brightness while maintaining the PWM signal constant, and above the given brightness by causing the drive current to be increasable from a level below the maximum prescribed current value to any level up to the maximum prescribed current value while maintaining the PWM signal to generate a fixed extended drive time period longer than the drive time period.

8. A display apparatus comprising:

a display panel;

a rewriting section that rewrites an image displayed on a screen of the display panel with a prescribed period;

a backlight used by the display panel to adjust luminance of the screen according to an arbitrary adjustment value; and a drive control section that controls an amount of drive current supplied to the backlight during a drive time period, during which the backlight is driven, and a length of the drive time period of the drive current, repeatedly in synchronization with the prescribed period that is also a period with which the drive time period and a rest time period, during which the drive current is stopped, alternate, wherein the rewriting section writes a frame of a same image twice during the prescribed period, the drive control section causes the drive time period to be included in a time period during which different images are not mixed together in a single frame, and causes the rest time period in which different images are mixed together in a single frame to be included in the rest time period, the prescribed period is a period of a vertical synchronization signal of the display panel, the drive control section, at a phase control point for synchronizing a PWM signal corresponding to the drive current with the vertical synchronization signal, which is a time that is earlier than the vertical synchronization signal by a prescribed time difference, controls an amount of the drive current and a length of the drive time period that repeats in synchronization with the prescribed period with which the drive time period and the rest time period alternate, and luminance of the display is continuously increasable by the drive control section by causing, at a lower brightness range, the drive current to be set to any level below a maximum prescribed current value during the drive time period up to a given brightness while maintaining the PWM signal constant, and above the given brightness by causing the drive current to be decreasable from the maximum prescribed current value while increasing the PWM signal to generate an increasing extended drive time period longer than the drive time period.

9. The display apparatus according to claim 8, wherein the prescribed value is set according to the prescribed drive time period and the maximum prescribed current value of the drive current supplied to the backlight.

10. A backlight drive method performed by a display apparatus that includes a display panel in which an image displayed on a screen of the display panel is rewritten with a prescribed period and a backlight used by the display panel to adjust luminance of the screen according to an arbitrary adjustment value, the method comprising:

controlling an amount of drive current supplied to the backlight during a drive time period, during which the backlight is driven, and a length of the drive time period of the drive current, repeatedly in synchronization with the prescribed period that is also a period with which the drive time period and a rest time period, during which driving is stopped, alternate, wherein the display panel writes a frame of a same image twice during the prescribed period, the controlling includes causing the drive time period to be included in a time period during which different images are not mixed together in a single frame, and causing the rest time period in which different images are mixed together in a single frame to be included in the rest time period, the prescribed period is a period of a vertical synchronization signal of the display panel, the drive control section, at a phase control point for synchronizing a PWM signal corresponding to the drive current with the vertical synchronization signal, which is a time that is earlier than the vertical synchronization signal by a prescribed time difference, controls an amount of the drive current and a length of the drive time period that repeats in synchronization with the prescribed period with which the drive time period and the rest time period alternate, and luminance of the display is continuously increasable by the drive control section by causing, at a lower brightness range, the drive current to be set to any level below a maximum prescribed current value during the drive time period up to a given brightness while maintaining the PWM signal constant, and above the given brightness by causing the drive current to be decreasable from the maximum prescribed current value while increasing the PWM signal to generate an increasing extended drive time period longer than the drive time period.

* * * * *